US006718156B2

(12) United States Patent
Lee et al.

(10) Patent No.: US 6,718,156 B2
(45) Date of Patent: Apr. 6, 2004

(54) WASTE TONER COLLECTING APPARATUS OF ELECTROPHOTOGRAPHIC IMAGE FORMING DEVICE

(75) Inventors: Jin-soo Lee, Gyeonggi-do (KR); Yong-baek Yoo, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/330,179

(22) Filed: Dec. 30, 2002

(65) Prior Publication Data

US 2003/0180077 A1 Sep. 25, 2003

(30) Foreign Application Priority Data

Mar. 20, 2002 (KR) ..... 2002-15115

(51) Int. Cl.[7] ..... G03G 21/12
(52) U.S. Cl. ..... 399/360; 399/159; 399/358
(58) Field of Search ..... 399/116, 117, 399/358, 360, 159

(56) References Cited

U.S. PATENT DOCUMENTS 4,572,655 A * 2/1986 Morrison et al. ..... 399/358
5,778,296 A * 7/1998 van der Steen et al. .... 399/360

FOREIGN PATENT DOCUMENTS

JP 08101614 A * 4/1996 ..... G03G/21/10

* cited by examiner

*Primary Examiner*—Susan S. Y. Lee
(74) *Attorney, Agent, or Firm*—Staas & Halsey LLP

(57) ABSTRACT

A waste toner collecting apparatus of an electrophotographic image forming device includes a photoreceptive drum having a first slit formed on an outer circumferential surface thereof in a lengthwise direction, through which waste toner removed from the outer circumferential surface of the photoreceptive drum by a cleaning blade contacting the outer circumferential surface thereof passes to be contained therein, and a slit opening/shutting unit which selectively opens and shuts the first silt. Thus, the image forming device can be made compact, and generation of dust can be prevented.

32 Claims, 7 Drawing Sheets

WASTE TONER COLLECTING APPARATUS OF ELECTROPHOTOGRAPHIC IMAGE FORMING DEVICE

CROSS-REFERENCE TO RELATED APPLICATIONS

This application claims the benefit of Korean Patent Application No. 2002-15115, filed Mar. 20, 2002, in the Korean Intellectual Property Office, the disclosure of which is incorporated herein by reference.

BACKGROUND OF THE INVENTION

1. Field of the Invention

The present invention relates to a waste toner collecting apparatus of an electrophotographic image forming device, and more particularly, to a waste toner collecting apparatus of an electrophotographic image forming device which collects waste toner into an inside of a photoreceptive drum.

2. Description of the Related Art

In general, an electrophotographic image forming device is a printing apparatus for forming an electrostatic latent image corresponding to a desired image by scanning a light beam onto a photoreceptive body and developing the electrostatic latent image using toner of a predetermined color to print a developed image on a sheet of paper.

FIG. 1 schematically shows a structure of a conventional electrophotographic color image forming device. Referring to FIG. 1, the image forming device includes a photoreceptive drum 10 that is a photoreceptive body, a charger 11 charging a surface of the photoreceptive drum 10 to a predetermined voltage, a laser scanning unit (LSU) 12 forming an electrostatic latent image corresponding to a desired image by scanning a light beam onto the charged surface of the photoreceptive drum 10, a development unit 13 developing the electrostatic latent image using toner of four colors of yellow (Y), magenta (M), cyan (C), and black (K), a transfer belt 14 receiving the developed image from the photoreceptive drum 10 and transferring the received image to a sheet of paper, a cleaning blade 21 removing waste toner remaining on the surface of the photoreceptive drum 10 after the image is transferred to the transfer belt 14, and a waste toner container 25 containing the removed waste toner. The image forming device further includes a discharger 18 and a path 19 along which the paper proceeds.

In the above-described structure, after the photoreceptive drum 10 is charged by the charger 11 to the predetermined voltage, the electrostatic latent image corresponding to the desired image is formed by scanning the light beam from the LSU 12 onto the charged surface of the photoreceptive drum 10. Next, the electrostatic latent image formed on the photoreceptive drum 10 is developed using toner of four colors supplied from a yellow developing unit 13*a*, a magenta developing unit 13*b*, a cyan developing unit 13*c*, and a black developing unit 13*d*. The developed images are transferred to the transfer belt 14 to overlap with one another to form a color image printed on the sheet of the paper.

In the meantime, the waste toner not transferred to the transfer belt 14 and remaining on the surface of the photoreceptive drum 10 is removed from the surface of the photoreceptive drum 10 by the cleaning blade 21. The removed waste toner is accumulated in the waste toner container 25.

In the electrophotographic image forming device, since the waste toner container is installed outside the photoreceptive drum, the device is difficult to be made compact. Also, since an inlet of the waste toner container is always in an open state, dust can be generated.

SUMMARY OF THE INVENTION

To solve the above and the other problems, it is an aspect of the present invention to provide a waste toner collecting apparatus of an electrophotographic image forming device which can collect waste toner into an inside of the photoreceptive drum so that the image forming device can be made compact.

Additional aspects and advantages of the invention will be set forth in part in the description which follows and, in part, will be obvious from the description, or may be learned by practice of the invention.

To achieve an aspect of the invention, a waste toner collecting apparatus of an electrophotographic image forming device includes a photoreceptive drum having a first slit formed at an outer circumferential surface thereof in a lengthwise direction, through which waste toner removed from the outer circumferential surface of the photoreceptive drum by a cleaning blade contacting the outer circumferential surface thereof passes to be contained therein, and a slit opening/shutting unit which selectively opens and shuts the first silt.

It is possible in the present invention that the slit opening/shutting unit opens the first slit formed at the outer circumferential surface of the photoreceptive drum for a predetermined period.

It is possible in the present invention that the slit opening/shutting unit comprises a cylindrical waste toner container which is installed inside the photoreceptive drum to be capable of rotating and has a second slit corresponding to the first slit formed at the outer circumferential surface thereof in a lengthwise direction, and a driving motor rotating the waste toner container.

BRIEF DESCRIPTION OF THE DRAWINGS

The above object and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
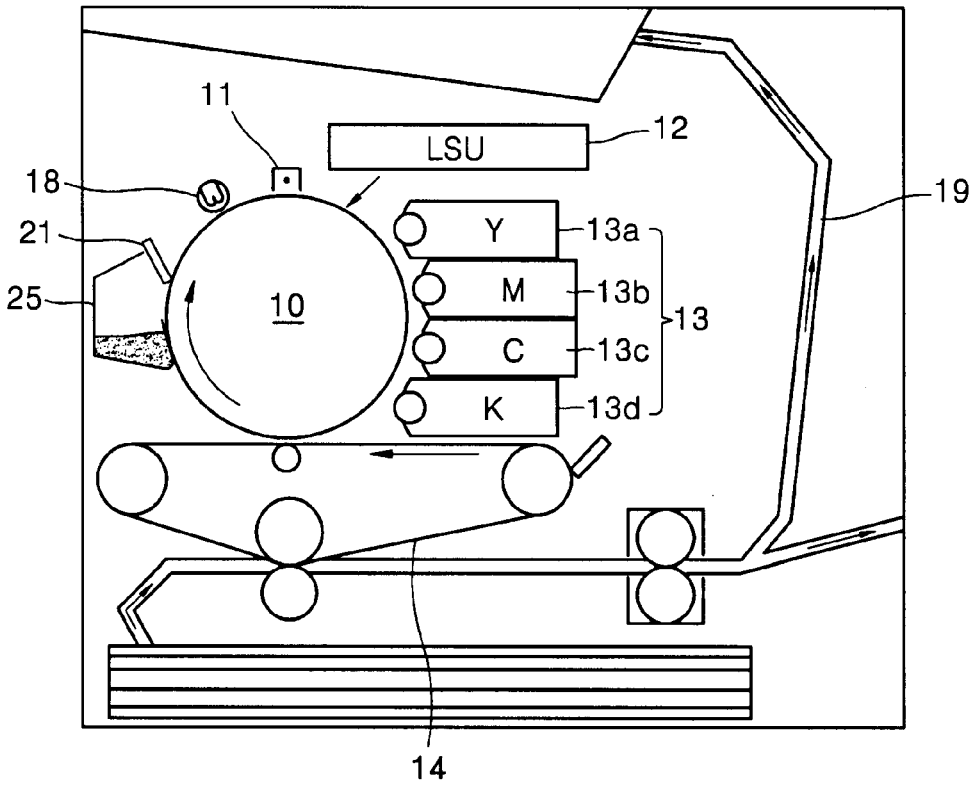
FIG. 1 (PRIOR ART)
FIG. 1 is a view schematically showing a structure of a conventional electrophotographic image forming device.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Figure 2:
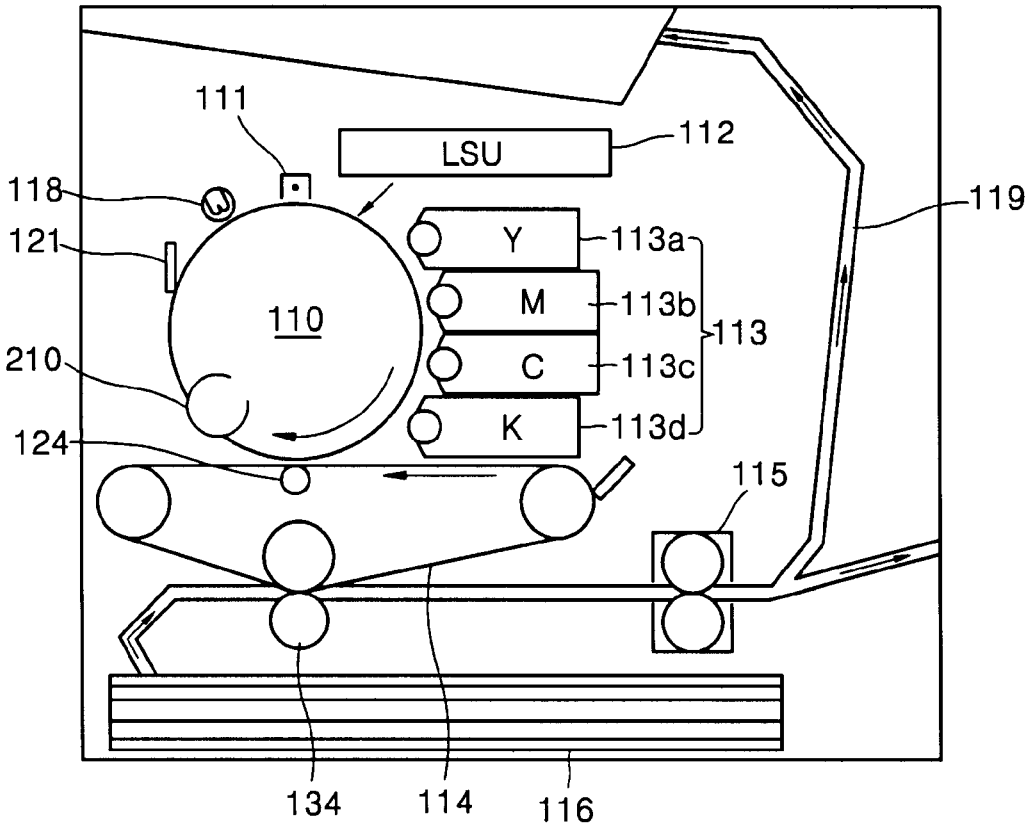
FIG. 2 is a view schematically showing a structure of an electrophotographic image forming device having a waste toner collecting apparatus according to an embodiment of the present invention.

FIG. 2 shows a structure of an electrophotographic color image forming device having a waste toner collecting apparatus according to an embodiment of the present invention.

Referring to FIG. 2, the electrophotographic color image forming device includes a photoreceptive drum 110 that is a photoreceptive body, a charger 111 charging a surface of the photoreceptive drum 110, a laser scanning unit (LSU) 112 forming a predetermined electrostatic latent image by scanning a light beam onto the charged surface of the photoreceptive drum 110, a development unit 113 developing the electrostatic latent image using toner of four colors of yellow (Y), magenta (M), cyan (C), and black (K), a transfer belt 114 to which the developed images of four colors developed on the photoreceptive drum 110 are transferred to overlap one another, a first transfer roller 124 transferring the developed images developed on the photoreceptive drum 110 to the transfer belt 114 to form a color image, a second transfer roller 134 transferring the color image of four colors overlapped on the transfer belt 114 to a sheet of paper, a fusing unit 115 permanently fixing the color image transferred to the paper by heating and pressing the paper, a cleaning blade 121 removing waste toner remaining on an outer circumferential surface of the photoreceptive drum 110 after the image is transferred to the transfer belt 114, and a waste toner container 210 installed inside the photoreceptive drum 110 to contain collected waste toner which is removed by the cleaning blade 121.

Here, four developing units 113*a*, 113*b*, 113*c*, and 113*d* provided at the development unit 113 are separated a predetermined distance from the photoreceptive drum 110 and sequentially moved toward the photoreceptive drum 110 by a contacting unit (not shown), so that a development roller provided at each tip end thereof contacts the photoreceptive drum 110 to transfer the toner to the photoreceptive drum 110. The electrophotographic color image forming device further includes a paper cassette 116, a discharger 118, and a movement path 119 of the paper.

An operation of forming an image in the above-described structure is described as follows. First, the charger 111 charges the surface of the photoreceptive drum 110 to a predetermined voltage. The LSU 112 scans the light beam onto the charged surface of the photoreceptive drum 110 to form the predetermined electrostatic latent image. Next, the electrostatic latent image formed on the photoreceptive drum 110 is developed by the development unit 113. Here, assuming that yellow color is first developed, the yellow developing unit 113*a* accesses the photoreceptive drum 110 to develop a yellow electrostatic latent image formed on the photoreceptive drum 110 by using toner of yellow color. The developed yellow image is transferred to the transfer belt 114 using the first transfer roller 124. Next, another electrostatic latent image for a second color is formed by charging the surface of the photoreceptive drum 110 and exposing the same to the light beam. If the second color is magenta, the magenta developing unit 113*b* accesses the photoreceptive drum 110 to develop a magenta electrostatic latent image for the second color.

The developed magenta image is transferred to the transfer belt 114 to overlap the yellow image which has been already transferred to the transfer belt 114. Likewise, a third cyan color image and a fourth black color image are developed and transferred so that the image of a desired color is finally completed on the transfer belt 114. The completed color image is transferred to the sheet of paper supplied between the transfer belt 114 and a second transfer roller 134. The paper is heated and pressed as it passes through the fusing unit 115, so that the image is permanently fixed on the paper.

In the meantime, waste toner which is not moved to the transfer belt 114 and remains on the surface of the photoreceptive drum 110 is removed by the cleaning blade 121 installed to contact the surface of the photoreceptive drum 110. The removed waste toner is collected by a waste toner collecting apparatus.

Figure 3:
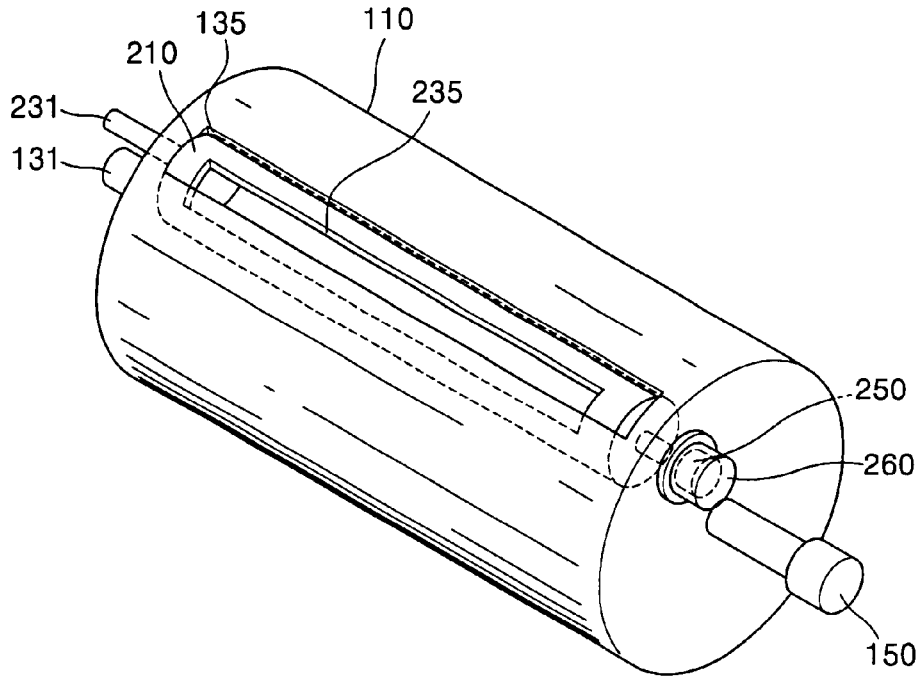
FIG. 3 is a perspective view of the waste toner collecting apparatus shown in FIG. 2.
Figure 4:
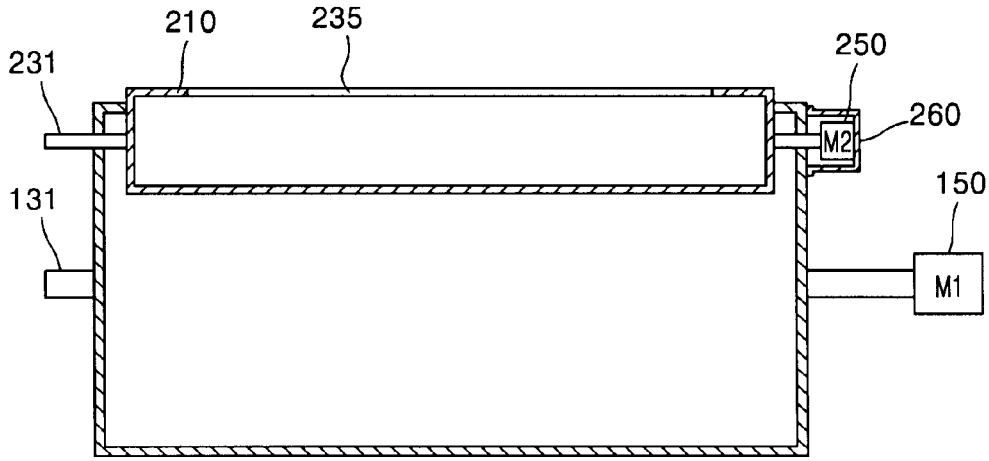
FIG. 4 is a sectional view of the waste toner collecting apparatus shown in FIG. 3.
Figure 5:
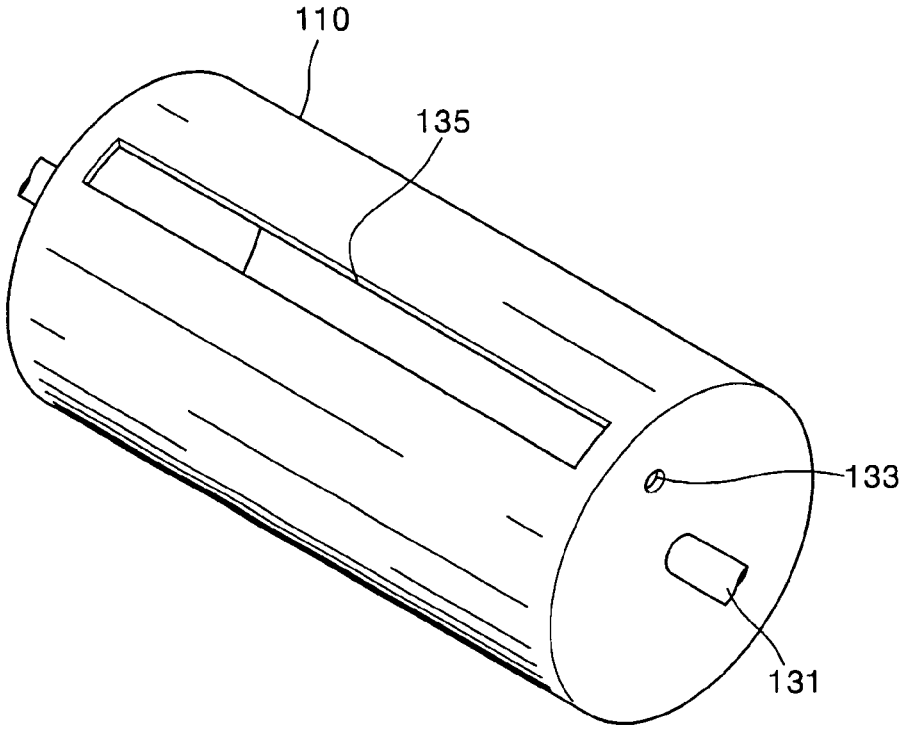
FIG. 5 is a perspective view of a photoreceptive drum shown in FIG. 3.
Figure 6:
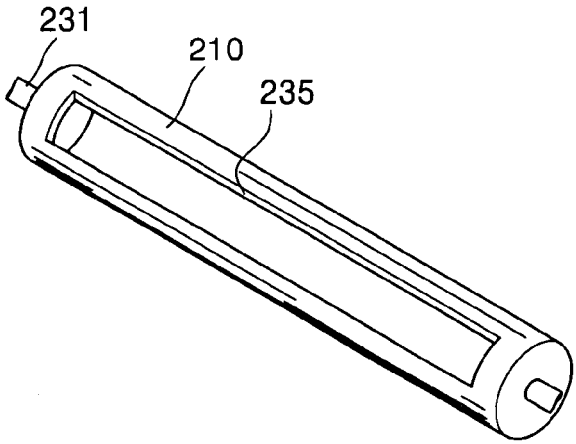
FIG. 6 is a perspective view of a waste toner container shown in FIG. 3.

FIGS. 3 and 4 show a waste toner collecting apparatus shown in FIG. 2. FIGS. 5 and 6 show the photoreceptive drum 110 and the waste toner container 210 shown in FIGS. 2 through 4.

Referring to the drawings, the waste toner collecting apparatus includes the photoreceptive drum 110 having a first slit 135 formed in a lengthwise direction on the outer circumferential surface thereof so that the waste toner can be collected and stored in the inside thereof, and the waste toner container 210 installed to rotate inside the photoreceptive drum 110 to selectively open and shut the first slit 135 as it rotates, so that the waste toner is collected through the first slit 135 and stored in the photoreceptive drum 110.

The first slit 135 is formed in the lengthwise direction on the outer circumferential surface of the photoreceptive drum 110 so that the waste toner removed by the cleaning blade 121 can enter the inside of the photoreceptive drum 110 through the first slit 135.

A through hole 133 into which a container center shaft 231 of the waste toner container 210 is inserted is formed at both side surfaces of the photoreceptive drum 110 so that the waste toner container 210 can rotate inside the photoreceptive drum 110.

A second slit 235 is formed in the lengthwise direction on an outer circumferential surface of the waste toner container 210 so that the first slit 135 can be open as the waste toner container 210 rotates.

A first driving motor 150 rotating the photoreceptive drum 110 is connected to a drum center shaft 131 of the photoreceptive drum 110. A second driving motor 250 for rotating the waste toner container 210 is connected to the container center shaft 231 of the waste toner container 210. Here, the second driving motor 250 is included in a motor case 260 attached to one side surface of the photoreceptive drum 110. Also, the second driving motor 250 is connected to a control unit (not shown) controlling a rotation of the waste toner container 210 so that the waste toner container 210 can open the first slit 135 when necessary.

FIGS. 7 through 11 show a process in which the waste toner is collected by the waste toner collecting apparatus having the above structure.

Figure 7:
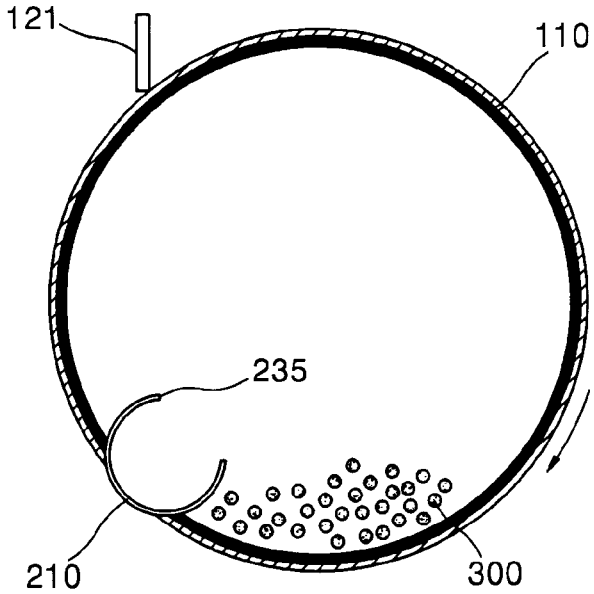
FIGS. 7 through 11 are views showing a process of collecting waste toner by the waste toner collecting apparatus shown in FIG. 3.

First, when the first slit 135 formed on the outer circumferential surface of the photoreceptive drum 110 is disposed far away from the cleaning blade 121 as shown in FIG. 7, the first slit 135 is closed by the waste toner container 210. Here, the second driving motor 250 is not driven.

Figure 8:
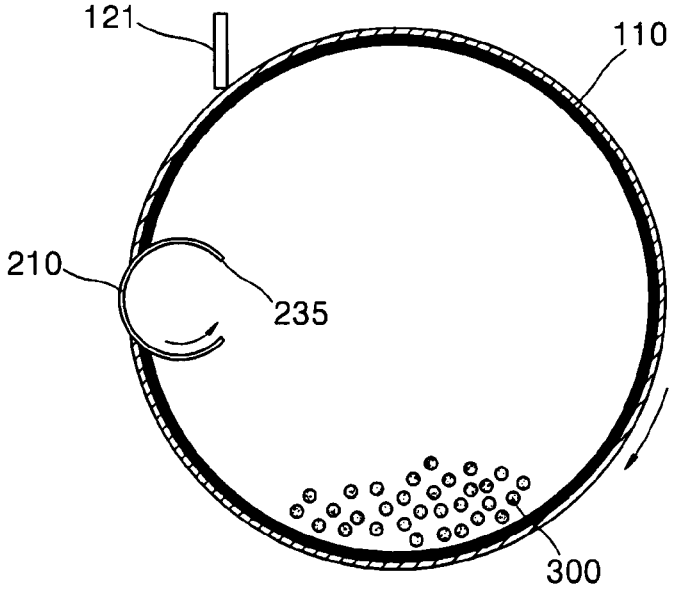

Next, when the first slit 135 moves toward the cleaning blade 121 as the photoreceptive drum 110 rotates by the first driving motor 150, and is disposed on a position shown in FIG. 8, the second driving motor 250 receives a signal from the control unit and is driven to rotate the waste toner container 210. Accordingly, the waste toner container 210 rotates inside the photoreceptive drum 110.

Figure 9:
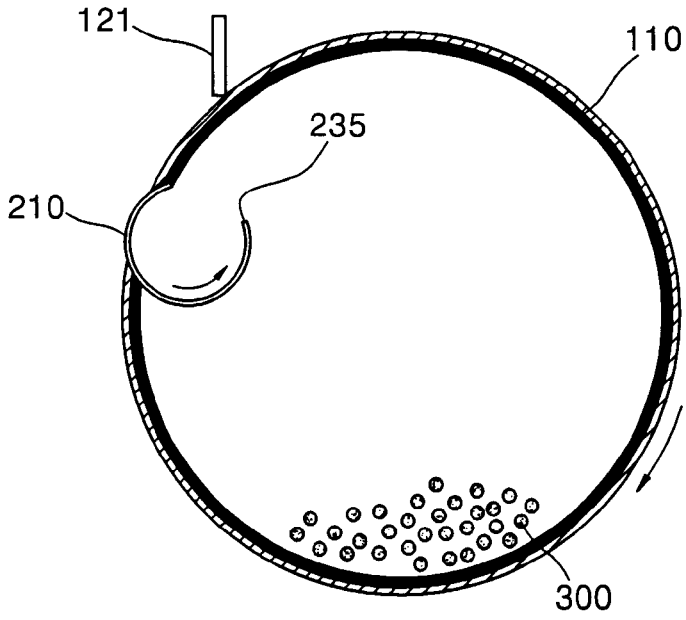
Figure 10:
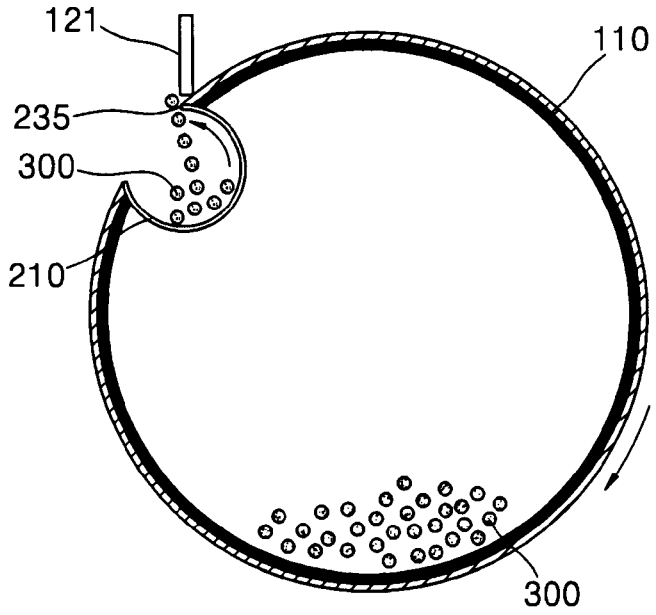

Next, as the photoreceptive drum 110 continues to rotate, the first slit 135 is closer to the cleaning blade 121 as shown in FIG. 9, and meets the cleaning blade 121 as shown in FIG. 10. In this process, the waste toner container 210 is rotated by the second driving motor 250. Accordingly, the first slit 135 is opened by the waste toner container 210 to communicate with the inside of the photoreceptive drum 110 through the second slit 235 formed on the outer circumferential surface of the waste toner container 210. Here, the waste toner 300 removed by the cleaning blade 121 enters into the waste toner container 210 through the first slit 135 that is open, and through the second slit 235.

Figure 11:
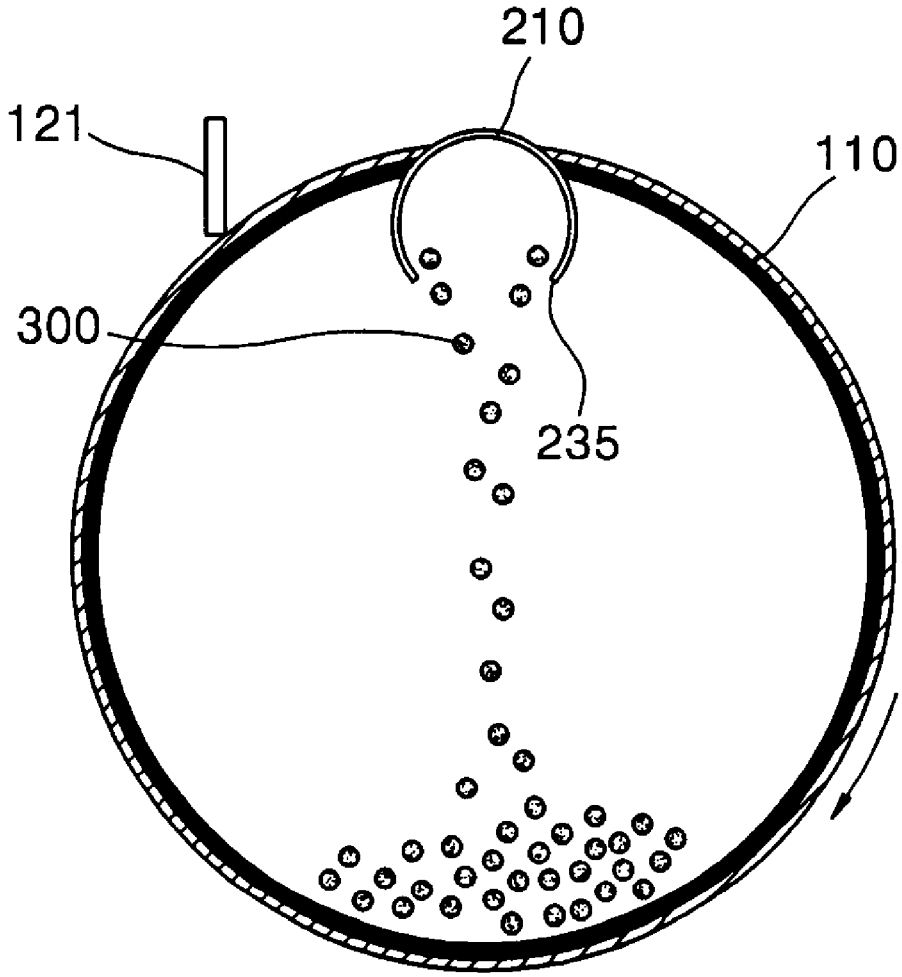

Next, as the photoreceptive drum 110 continues to rotate, the first slit 135 is closed as it passes the cleaning blade 121, as shown in FIG. 11. Here, the waste toner 300 contained in the waste toner container 210 drops through the second slit 235 into the photoreceptive drum 110. From this moment, the control unit stops driving of the second driving motor 250. The stopped second driving motor 250 begins driving again when the first slit 135 arrives at the position shown in FIG. 8 as the photoreceptive drum 110 rotates.

As the photoreceptive drum 110 repeats the above rotation, the above-described operation is repeated. Accordingly, the waste toner 300 is accumulated in the inside of the photoreceptive drum 110.

As described above, in the waste toner collecting apparatus of the electrophotographic image forming device according to the present invention, since the waste toner is collected into the photoreceptive drum, the additional waste toner container is not needed. Therefore, the image forming device can be made compact. Also, since the first slit formed on the outer circumferential surface of the photoreceptive drum is opened only when necessary, generation of dust can be prevented.

While this invention has been particularly shown and described with reference to a preferred embodiment thereof, it will be understood by those skilled in the art that various changes in form and details may be made therein without departing from the spirit and scope of the invention as defined by the appended claims and their equivalents.

What is claimed is:

1. A waste toner collecting apparatus of an electrophotographic image forming device, comprising:

a photoreceptive drum;

a cleaning blade removing waste toner from an outer circumferential surface of the photoreceptive drum;

a first slit formed on the outer circumferential surface of the photoreceptive drum in a lengthwise direction, through which waste toner removed from the outer circumferential surface of the photoreceptive drum by the cleaning blade passes to be contained in an inside of the photoreceptive drum; and a slit opening/shutting unit which selectively opens and shuts the first silt.

2. The apparatus as claimed in claim 1, wherein the slit opening/shutting unit opens the first slit formed on the outer circumferential surface of the photoreceptive drum for a predetermined period.

3. The apparatus as claimed in claim 2, wherein the slit opening/shutting unit comprises:

a cylindrical waste toner container which is installed inside the photoreceptive drum to be capable of rotating and has a second slit corresponding to the first slit and formed on the outer circumferential surface thereof in a lengthwise direction; and a driving motor rotating the waste toner container with respect to the photoreceptive drum.

4. A waste toner collecting apparatus of an electrophotographic image forming device, comprising:

a photoreceptive drum having a cylindrical outer circumferential surface;

a first slit formed on the cylindrical outer circumferential surface of the photoreceptive drum to communicate with an inside of the photoreceptive drum, through which waste toner removed from the cylindrical outer circumferential surface of the photoreceptive drum passes to be collected and stored in the inside of the photoreceptive drum; and a slit opening/shutting unit which selectively opens and shuts the first silt.

5. The apparatus as claimed in claim 4, wherein the first slit is formed in a lengthwise direction of the photoreceptive drum.

6. The apparatus as claimed in claim 4, wherein the slit opening/shutting unit rotates together with the photoreceptive drum.

7. The apparatus as claimed in claim 4, wherein the slit opening/shutting unit opens and shuts in response to a rotation of the photoreceptive drum.

8. The apparatus as claimed in claim 4, wherein the first slit of the photoreceptive drum moves to a first position and a second position when the photoreceptive drum rotates, and the slit opening/shutting unit opens the first slit when the first slit is in the first position, and shuts the first slit when the first slit is in the second position.

9. The apparatus as claimed in claim 4, further comprising:

a cleaning blade removing the waste toner from the cylindrical outer circumferential surface of the photoreceptive drum, wherein the removed waste toner is stored in the inside of the photoreceptive drum through the first slit.

10. The apparatus as claimed in claim 9, wherein the cleaning blade is disposed to be parallel to the first slit.

11. The apparatus as claimed in claim 9, wherein the slit opening/shutting unit opens the first slit when the first slit is disposed adjacent to the cleaning blade.

12. The apparatus as claimed in claim 9, wherein the first slit is disposed at one of a first position adjacent to the cleaning blade and a second position away from the cleaning blade while the photoreceptive drum rotates with respect to the cleaning blade.

13. The apparatus as claimed in claim 12, wherein the slit opening/shutting unit opens the first slit when the first slit is disposed at the first position to receive the removed waste toner.

14. The apparatus as claimed in claim 12, wherein the slit opening/shutting unit shuts the first slit to prevent the stored waste toner in the inside of the photoreceptive drum from leaking from the inside of the photoreceptive drum to an outside of the photoreceptive drum through the first slit.

15. The apparatus as claimed in claim 4, wherein the slit opening/shutting unit comprises:

a cylindrical waste toner container which is installed inside the photoreceptive drum to rotate with respect to the photoreceptive drum and has a second slit opening the first slit when the second slit of the cylindrical waste toner container is disposed to correspond to the first slit of the photoreceptive drum.

16. The apparatus as claimed in claim 15, wherein the photoreceptive drum rotates in a first direction, and the cylindrical waste toner container rotates in a second direction.

17. The apparatus as claimed in claim 16, wherein the first direction of the photoreceptive drum is opposite to the second direction of the cylindrical waste toner container.

18. The apparatus as claimed in claim 15, wherein the photoreceptive drum rotates about a first axis, and the cylindrical waste toner rotates about a second axis.

19. The apparatus as claimed in claim 15, wherein the second slit is formed in a lengthwise direction of the cylindrical waste toner container.

20. The apparatus as claimed in claim 15, further comprising:

a first motor rotating the photoreceptive drum; and a second motor rotating the cylindrical waste toner container.

21. The apparatus as claimed in claim 20, wherein the photoreceptive drum comprises a side plate disposed on a side of the cylindrical outer circumferential surface of the photoreceptive drum, and the second motor is disposed on the side plate of the photoreceptive drum.

22. The apparatus as claimed in claim 20, wherein the photoreceptive drum comprises a side plate and a through hole, and the cylindrical waste toner container comprises:

a container shaft inserted into the through hole of the side plate of the photoreceptive drum to be connected to the second motor.

23. The apparatus as claimed in claim 22, wherein the photoreceptive drum comprises a drum shaft about which the photoreceptive drum rotates and to which the first motor is connected, and the through hole is disposed away from the drum shaft and adjacent to the cylindrical outer circumferential surface of the photoreceptive drum.

24. The apparatus as claimed in claim 20, wherein the first motor is fixedly coupled to the electrophotographic image forming device, and the second motor rotates with respect to one of the first motor and the photoreceptive drum.

25. The apparatus as claimed in claim 15, wherein the photoreceptive drum has a first diameter, and the cylindrical waste toner container has a second diameter different from the first diameter.

26. The apparatus as claimed in claim 15, wherein the cylindrical waste toner container rotates together with the photoreceptive drum and rotates with respect to the photoreceptive drum.

27. The apparatus as claimed in claim 15, wherein the cylindrical waste toner container comprises an inside, and the second slit communicates with the inside of the cylindrical waste toner container.

28. The apparatus as claimed in claim 4, wherein the waste toner falls into the inside of the photoreceptive drum through the first slit and the slit opening/shutting unit by gravity.

29. A waste toner collecting apparatus of an electrophotographic image forming device, comprising:

a photoreceptive drum having a first cylindrical outer circumferential surface;

a first slit formed on the cylindrical outer circumferential surface of the photoreceptive drum to communicate with an inside of the photoreceptive drum, through which waste toner removed from the cylindrical outer circumferential surface of the photoreceptive drum passes to be collected and stored in the inside of the photoreceptive drum;

a slit opening/shutting unit having a cylindrical waste toner container which is installed inside the photoreceptive drum to rotate with respect to the photoreceptive drum and selectively opens and shuts the first slit; and a second slit formed on the cylindrical waste toner container to communicate with the first slit so that the waste toner passes through the first slit and second slit and is stored in the inside of the photoreceptive drum when the slit opening/shutting unit opens the first slit.

30. The apparatus as claimed in claim 29, wherein the cylindrical waste toner container shuts the first slit to prevent the stored waste toner from leaking through the first slit while the photoreceptive drum rotates.

31. The apparatus as claimed in claim 29, wherein the waste toner is temporarily contained in an inside of the cylindrical waste toner container and falls into the inside of the photoreceptive drum through the second slit of the opening/shutting unit when the cylindrical waste toner container shuts the first slit.

32. The apparatus as claimed in claim 29, wherein the photoreceptive drum has a radius, and the cylindrical waste toner container has a diameter less than the radius of the photoreceptive drum.

* * * * *